US006116581A

United States Patent [19]

Watanabe et al.

[11] Patent Number: 6,116,581

[45] Date of Patent: Sep. 12, 2000

[54] CHOKE SYSTEM FOR A SMALL FOUR-CYCLE ENGINE

[75] Inventors: Mitsunori Watanabe, Shizuoka-ken; Kenji Imafuku; Takanobu Koguchi, both of Tokyo, all of Japan

[73] Assignees: Fuji Robin Kabushiki Kaisha, Shizuoka-ken; Shin-Daiwa Kogyo Co., Ltd., Hiroshima-ken, both of Japan

[21] Appl. No.: 09/185,603

[22] Filed: Nov. 3, 1998

[30] Foreign Application Priority Data

Nov. 25, 1997 [JP] Japan ..... 9-323445

[51] Int. Cl.[7] ..... F02M 1/02

[52] U.S. Cl. ..... 261/64.6; 123/179.18

[58] Field of Search ..... 261/64.6, 64.1; 123/179.18

[56] References Cited

U.S. PATENT DOCUMENTS

| | | | |
|---|---|---|---|
| 2,982,275 | 5/1961 | Doman et al. | 261/64.6 X |
| 3,453,994 | 7/1969 | Nutten et al. | 261/64.6 X |
| 3,823,700 | 7/1974 | Gumtow | 261/64.6 X |
| 4,254,064 | 3/1981 | Bernauer et al. | 261/64.6 |
| 4,788,014 | 11/1988 | Kanno | 261/64.6 X |
| 5,200,118 | 4/1993 | Hermle | 261/64.6 |
| 5,693,264 | 12/1997 | Fricke | 261/64.6 |
| 5,827,455 | 10/1998 | Nakai | 261/64.6 X |
| 6,000,683 | 12/1999 | Van Allen | 261/64.6 X |

FOREIGN PATENT DOCUMENTS 7-22054 4/1995 Japan .

*Primary Examiner*—Richard L. Chiesa
*Attorney, Agent, or Firm*—Arent Fox Kintner Plotkin & Kahn PLLC

[57] ABSTRACT

A four-cycle engine has a base plate provided on a side of the engine and having an opening communicated with a carburetor. A choke plate is pivotally mounted on the base plate, and a choke lever is pivotally mounted on the base plate. A transmitting means is provided for transmitting the opposite rotation of the choke lever to the choke plate so as to rotate the choke plate.

5 Claims, 4 Drawing Sheets

CHOKE SYSTEM FOR A SMALL FOUR-CYCLE ENGINE

BACKGROUND OF THE INVENTION

The present invention relates to a choke system for a small four-cycle engine.

The choke system for a small engine has a choke plate and a choke lever for rotating the choke plate. When starting an engine, especially a cold engine, the choke lever is operated to restrict or choke off the airflow to produce a richer air-fuel mixture.

For a portable engine used in the bush cutter, hedge trimmer, blower, etc, the two-cycle engine is employed, since, the two-cycle engine is small and lightweight and has a large power compared with the same sized four-cycle engine.

In the two-cycle engine, the carburetor is provided on a side of the cylinder block as described in Japanese Utility Model Laid Open Publication 7-22054. Namely, the carburetor is disposed at a position lower than the cylinder head, and hence the choke system attached to the carburetor can also be located at a lower position. Therefore, the two-cycle engine can be designed to be small in size.

However, in recent years, demand for the four-cycle engine is rising because of the emission control.

But, in the four-cycle engine of the over head valve type, the carburetor is disposed on a side portion of the cylinder head, so that the choke system is provided at the same level of the cylinder head or a higher level than the cylinder head. As a result, the engine can not be reduced in size.

On the other hand, the choke lever is disposed on a side portion of the engine. When the choke lever is upwardly rotated, the choke plate is closed, and when downwardly operating, the choke plate is opened. This operating manner has become custom. Therefor, the operating manner must be kept.

SUMMARY OF THE INVENTION

An object of the present invention is to provide a choke system of the four-cycle engine which may be reduced in size, keeping the conventional operating manner of the choke lever.

According to the present invention, there is provided a choke system for four-cycle engine having a cylinder head and a carburetor provided in the cylinder head, the system comprising a base plate provided on a side of the engine and having an opening communicated with the carburetor, a choke plate pivotally mounted on the base plate, and provided to close the opening, a choke lever pivotally mounted on the base plate, and outwardly projected from the base plate, transmitting means for transmitting opposite rotation of the choke lever to the choke plate so as to rotate the choke plate.

The transmitting means comprises a toothed flange formed on a periphery of each of the choke plate and choke lever, and the transmitting means is provided so that the choke plate closes the opening when the choke lever is upwardly rotated.

The choke lever comprises a shaft portion and an arm, the arm has a size so as to be inserted in a hole of the pivot of the choke lever, the shaft portion is rotatably inserted in a hole formed in the base plate.

A fixing plate is attached to the base plate together with the choke plate and the choke lever, and an end portion of the fixing plate is abutted on an end of the shaft portion of the choke lever so as to rotatably hold the shaft portion in the hole.

These and other objects and features of the present invention will become more apparent from the following detailed description with reference to the accompanying drawings.

DETAILED DESCRIPTION OF THE PREFERRED EMBODIMENT

Figure 1:
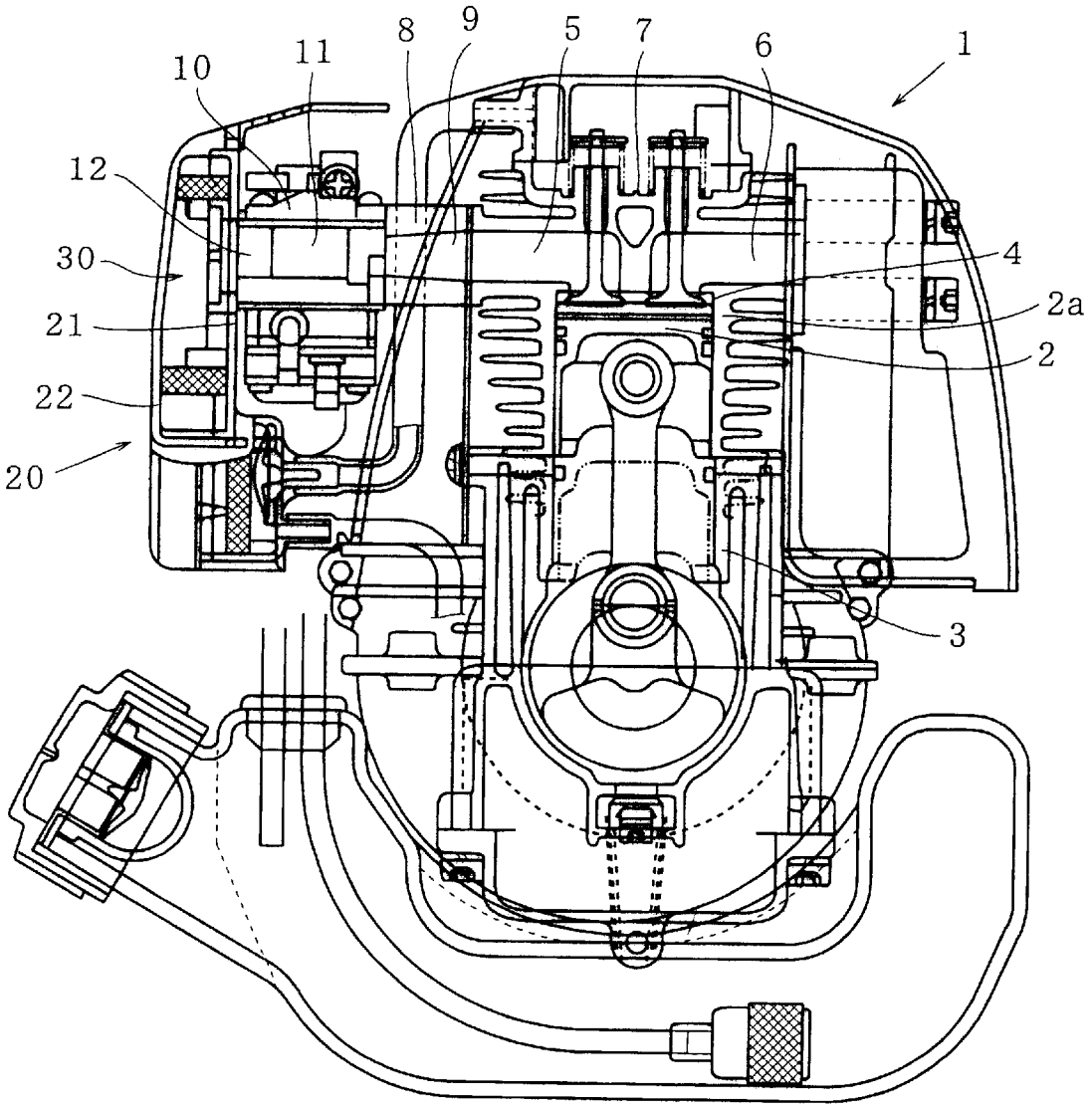
FIG. 1 is a sectional front view of a four-cycle engine provided with a choke system of the present invention.

Referring to FIG. 1, a portable four cycle engine 1 to which the present invention is applied is a single cylinder four-cycle engine of the over head valve type. The engine 1 has a cylinder block 3 in which a cylinder 2*a* and a piston 2 are provided, a combustion chamber 4 formed in the cylinder block 3, and a cylinder head 7 having an intake port 5, and an exhaust port 6.

The intake port 5 is opened at a side wall of the cylinder head 7, and communicated with an intake manifold 8. On the end of the intake manifold 8, a carburetor 10 is provided. The carburetor 10 has an air passage 11 coaxial with an intake passage 9 of the intake manifold 8. The air passage 11 extends horizontally, namely in the direction perpendicular to the axis of the cylinder 2*a*. At an opening 12 of the air passage 11, an air cleaner box 20 is provided. The air cleaner box 20 comprises a base plate 21 and a cover 22. A guide plate 22*a* is fixed on the cover 22. In the base plate 21, an opening 23 is formed, communicated with the opening 12 of the air passage 11. The opening 23 is surrounded by an annular projected peripheral wall 23*a*. On a horizontal line 23*b* passing the center of the opening 23, a pair of guide pipes 25 and 26 are formed at opposite sides of the opening 23, and the guide pipes 25 and 26 are fixed in the base plate 21.

Adjacent to the opening 23, a choke system 30 is provided. The choke system 30 comprises a choke plate 31 and a choke lever 32. The choke plate 31 comprises a large diameter plate 31*a* and a small diameter plate 31*b* integral with the large diameter plate 31*a*. The choke plate 31 is pivotally secured to the base plate 21 by a guide pipe 25, and screw 24 screwed in the carburetor 10, interposing a fixing plate 33 at the small diameter plate 31*b*. Another end portion of the fixing plate 33 is secured to the base plate 21 by a screw 24*a* screwed in the carburetor 10.

The large diameter plate 31*a* has a small opening 31*f* and is adapted to be slid on the peripheral wall 23*a* so as to close the opening 23.

The choke lever 32 comprises an arm 32*a*, a manipulating portion 32*b* outwardly projected from the cover 22, and a shaft portion 32*c* pivotally engaged with a hole 27 formed in the base plate 21 at a position near the horizontal line 23*b* so as to be aligned with the guide pipes 25, 26. The shaft portion 32*c* has a spherical shoulder 32*d*.

The shaft portion 32*c* has a toothed flange 32*e* projected from the periphery thereof. The teeth of the toothed flange 32*e* is engaged with teeth of a toothed flange 31*g* formed on the small diameter plate 31*b*. Thus, by rotating the arm 32*a* of the choke lever 32, the choke plate 31 is rotated about the guide pipe 25.

Figure 4A:
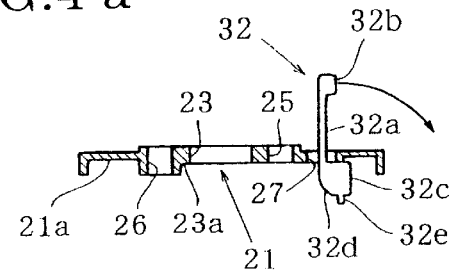
FIGS. 4*a* to 4*j* show an assembling method of a choke lever.
Figure 4B:
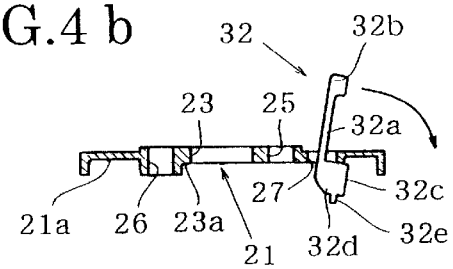
Figure 4C:
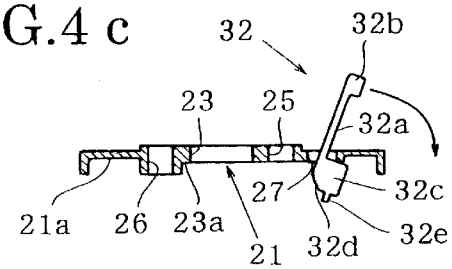
Figure 4D:
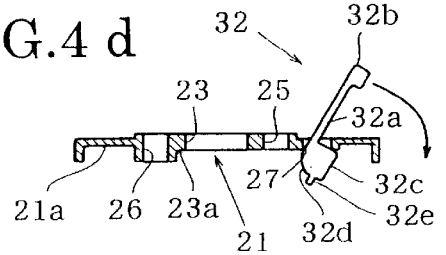
Figure 4E:
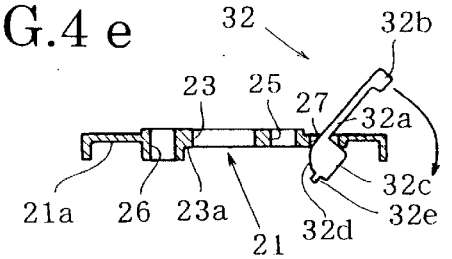
Figure 4F:
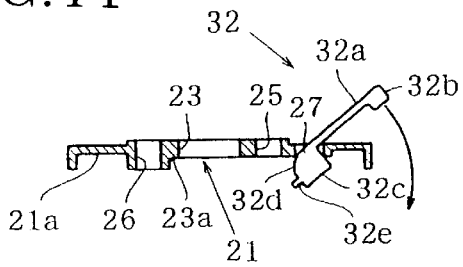
Figure 4G:
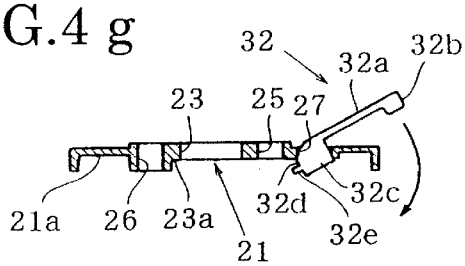
Figure 4H:
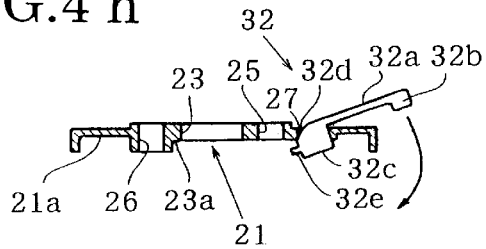
Figure 4I:
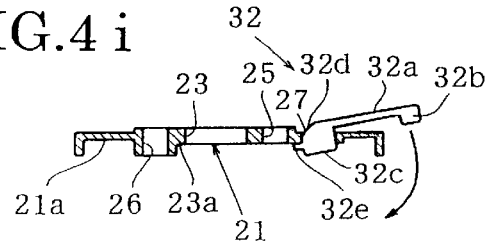
Figure 4J:
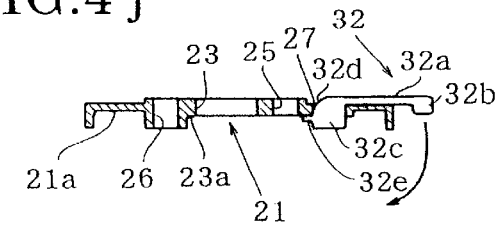

FIGS. 4*a* to 4*j* show method for attaching the choke lever 32 to the base plate 21 of the air cleaner box 20. The choke lever 32 is inserted in the hole 27 at the manipulating portion 32*b* as shown in FIG. 4*a* until the shaft portion 32*c* abuts the base plate 21. Then the arm 32*a* in rotated in the clockwise direction about the contact point of the shaft portion 32*c* with the base plate 21. The spherical shoulder 32*d* enters the hole 27, rotating. Finally, the choke lever 32 is attached to the base plate 21 as shown in FIG. 4*j*. At the position, an end portion 33*c* of the fixing plate 33 is abutted on the end of the shaft portion 32*c* of the choke lever 32 so that the choke lever is rotatably held in the hole 27. Thus, the toothed flange 32*e* is resiliently contacted with the base plate 21.

Figure 2:
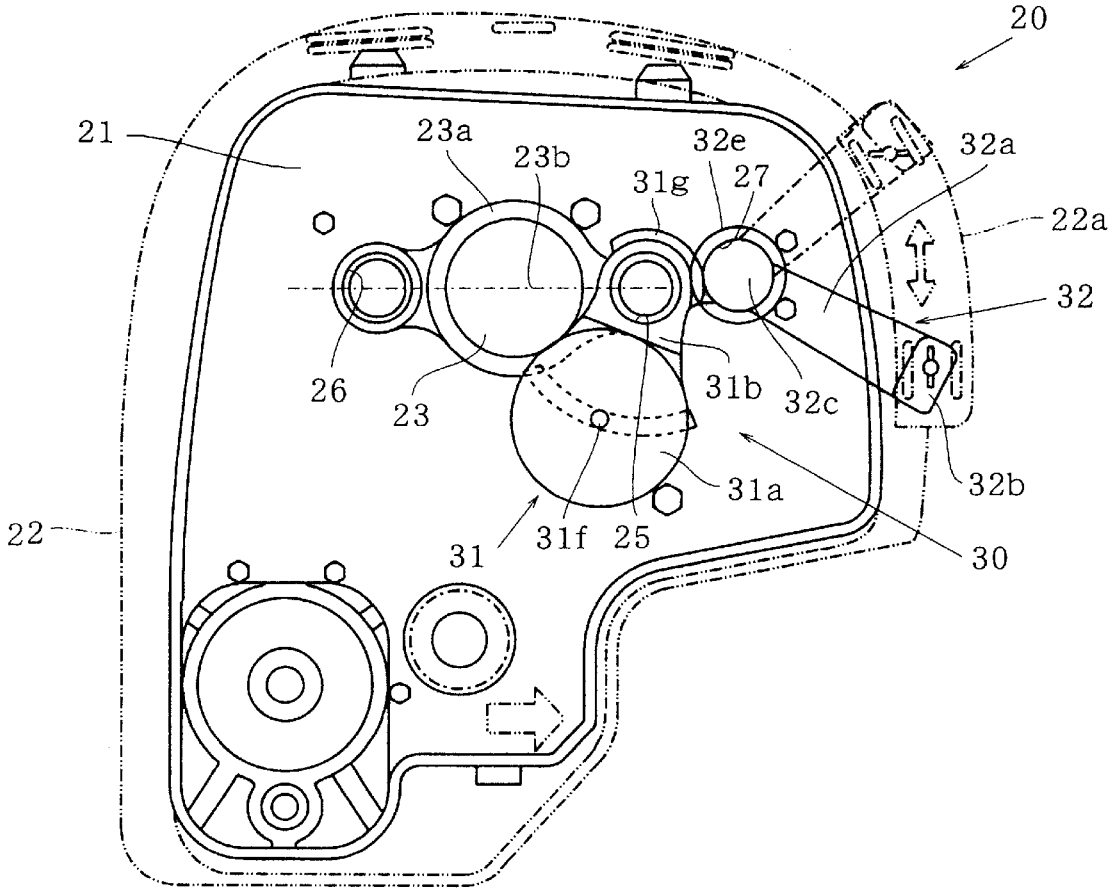
FIG. 2 is a side view of the engine, removing a cover for showing the choke system.
Figure 3:
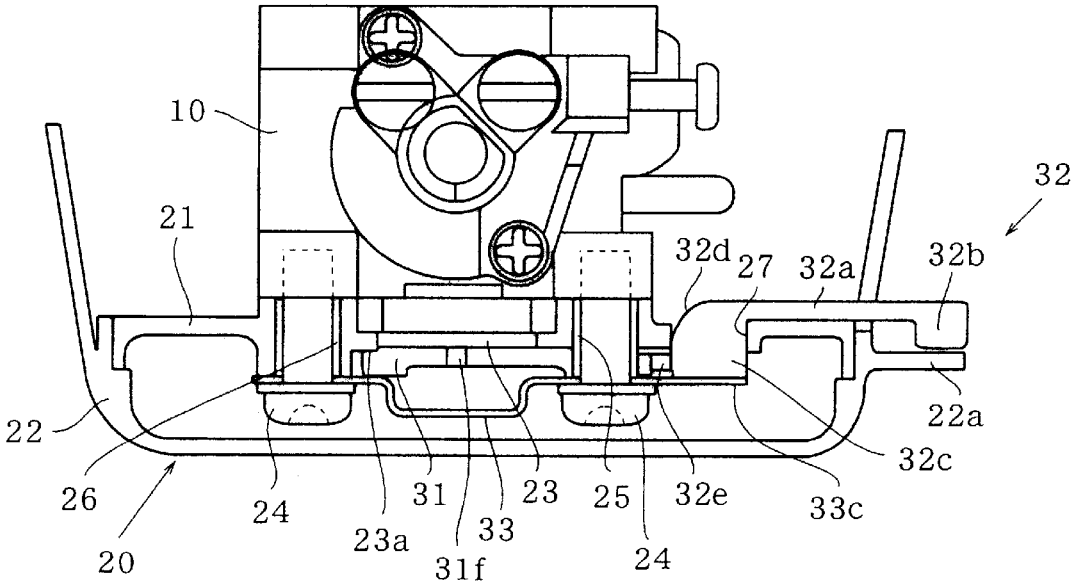
FIG. 3 is a plan view of the choke system.

In operation, when the choke lever 32 is downwardly rotated as shown in FIG. 2, the choke plate 31 is rotated in the counter clockwise direction and downwardly. Thus, the opening 23 is opened as shown in FIG. 2. When the choke lever 32 is upwardly rotated shown by the broken line in FIG. 2, the choke plate 31 closes the opening 23. This manipulation is the same as the conventional manner.

Since the opening 23 is communicated with the air passage 11 of the carburetor 10, the pivot of the choke plate 31 and the pivot of the choke lever 32 are arranged approximately in the horizontal direction, the height of the engine 1 can be reduced. In addition the manipulating portion 32*b* of the choke lever 32 when upwardly rotated can be located at lower position, thereby preventing the choke lever from catching foreign things.

Furthermore, since the pivot of the choke lever is positioned near the outside wall of the air cleaner box, the length of the choke lever can be reduced.

While the invention has been described in conjunction with preferred specific embodiment thereof, it will be understood that this description is intended to illustrate and not limit the scope of the invention, which is defined by the following claims.

What is claimed is:

1. A choke system for a four-cycle engine having a cylinder head and a carburetor provided in the cylinder head, the system comprising:

a base plate provided on a side of the engine and having an opening communicated with the carburetor;

a choke plate pivotally mounted on the base plate, and provided to close the opening;

a choke lever pivotally mounted on the base plate, and outwardly projected from the base plate;

transmitting means for transmitting opposite rotation of the choke lever to the choke plate so as to rotate the choke plate.

2. The system according the claim 1 wherein the transmitting means comprises a toothed flange formed on a periphery of each of the choke plate and choke lever.

3. The system according to claim 1 wherein the transmitting means is provided so that the choke plate closes the opening when the choke lever is upwardly rotated.

4. The system according to claim 1 wherein the choke lever comprises a shaft portion and an arm, the arm has a size so as to be inserted in a hole of the pivot of the choke lever, the shaft portion is rotatably inserted in a hole formed in the base plate.

5. The system according to claim 4 further comprising a fixing plate attached to the base plate together with the choke plate and the choke lever, and an end portion of the fixing plate being abutted on an end of the shaft portion of the choke lever so as to rotatably hold the shaft portion in the hole.

* * * * *